US008607886B2

(12) United States Patent
Harrington et al.

(10) Patent No.: US 8,607,886 B2
(45) Date of Patent: Dec. 17, 2013

(54) COMBINED PLUG AND SEALING RING FOR SPRINKLER NOZZLE AND RELATED METHODS

(75) Inventors: John Harrington, Medfield, MA (US); Paul Po-Cheng Su, East Setauket, NY (US); David Fuller, Millville, MA (US)

(73) Assignee: FM Global Technologies, LLC, Johnston, RI (US)

( * ) Notice: Subject to any disclaimer, the term of this patent is extended or adjusted under 35 U.S.C. 154(b) by 40 days.

(21) Appl. No.: 13/067,335

(22) Filed: May 25, 2011

(65) Prior Publication Data

US 2011/0272167 A1 Nov. 10, 2011
US 2012/0132446 A2 May 31, 2012

Related U.S. Application Data

(63) Continuation-in-part of application No. 12/000,060, filed on Dec. 7, 2007, now abandoned.

(60) Provisional application No. 60/878,067, filed on Jan. 3, 2007.

(51) Int. Cl.
*A62C 37/08* (2006.01)
*B05B 1/34* (2006.01)

(52) U.S. Cl.
USPC ..... 169/37; 169/38; 169/39; 169/41; 239/518; 239/523; 239/524

(58) Field of Classification Search
USPC ..... 169/37–41; 239/518, 523, 534, 602, 239/289; 292/1, 288, DIG. 38
See application file for complete search history.

(56) References Cited

U.S. PATENT DOCUMENTS

| | | | | |
|---|---|---|---|---|
| 3,393,746 | A * | 7/1968 | Hodnett | 169/41 |
| 3,698,483 | A | 10/1972 | Martin et al. | |
| 4,099,573 | A * | 7/1978 | Sahara | 169/37 |
| 4,395,303 | A | 7/1983 | Weir | |
| 4,533,414 | A | 8/1985 | Asphahani | |
| 4,749,321 | A * | 6/1988 | Knohl et al. | 411/371.1 |
| 5,505,383 | A * | 4/1996 | Fischer | 239/518 |
| 5,628,367 | A | 5/1997 | Truax et al. | |
| 5,713,524 | A * | 2/1998 | Greene et al. | 239/596 |
| 5,879,818 | A | 3/1999 | Kinomura et al. | |
| 5,921,322 | A | 7/1999 | Bonfield et al. | |
| 6,037,061 | A | 3/2000 | Ohmi | |

(Continued)

OTHER PUBLICATIONS

Halar® Powder Coatings ECTFE, printed Jul. 28, 2010, Plas-Tech Coatings, http://www.plastechcoatings.com/halar_coating.html.

(Continued)

*Primary Examiner* — Len Tran
*Assistant Examiner* — Alexander M Valvis
(74) *Attorney, Agent, or Firm* — Venable LLP; Steven J. Schwarz

(57) ABSTRACT

A combined plug and sealing ring for a sprinkler nozzle includes a nozzle plug having a substantially cylindrical portion adapted to engage within a nozzle orifice of a sprinkler nozzle, and a cap overlaying the substantially cylindrical portion. A sealing ring is adapted to seat onto a threaded pipe fitting portion of the sprinkler nozzle. A leash interconnects the nozzle plug and the sealing ring. A combined plug and sealing ring in combination with a sprinkler nozzle, and a method of installing a sprinkler nozzle in a highly corrosive or extremely corrosive environment are also disclosed.

20 Claims, 4 Drawing Sheets

(56) References Cited

U.S. PATENT DOCUMENTS

| | | | | |
|---|---|---|---|---|
| 6,112,821 | A * | 9/2000 | Yokoi | 169/41 |
| 6,207,241 | B1 | 3/2001 | Mody et al. | |
| 6,296,062 | B1 * | 10/2001 | Sundholm | 169/37 |
| 6,345,670 | B1 * | 2/2002 | Sundholm | 169/37 |
| 6,347,669 | B1 * | 2/2002 | Sundholm | 169/37 |
| 6,454,017 | B1 * | 9/2002 | Fischer et al. | 169/37 |
| 6,561,218 | B2 | 5/2003 | Mudd | |
| 6,749,894 | B2 | 6/2004 | Subramanian et al. | |
| 6,808,802 | B2 | 10/2004 | Lynn | |
| 7,192,638 | B2 * | 3/2007 | Tomihashi et al. | 428/327 |
| 7,485,199 | B2 * | 2/2009 | Sugahara | 148/427 |
| 8,220,556 | B2 * | 7/2012 | Retzloff et al. | 169/37 |
| 2003/0192430 | A1 | 10/2003 | Pearlstein et al. | |
| 2004/0134670 | A1 * | 7/2004 | Orr et al. | 169/37 |
| 2006/0060671 | A1 * | 3/2006 | Orr et al. | 239/461 |
| 2006/0104806 | A1 * | 5/2006 | Giesler et al. | 415/111 |
| 2007/0014706 | A1 * | 1/2007 | Herden et al. | 422/168 |
| 2007/0075503 | A1 * | 4/2007 | Hayashi et al. | 277/589 |
| 2007/0224244 | A1 * | 9/2007 | Weber et al. | 424/426 |

OTHER PUBLICATIONS

"Torlon® Al-10 Coatings," Solvay Advanced Polymers, Technical Bulletin, 2006.

J. Idris Jones, "The Reaction of Hydrazine With Polyimides, and Its Utility," J. Polymer Science, Part C, No. 22, pp. 773-784, 1969.

Solvent & Chemical Resistance Information, Carlisle, pp. 140-141.

* cited by examiner

COMBINED PLUG AND SEALING RING FOR SPRINKLER NOZZLE AND RELATED METHODS

CROSS-REFERENCE TO RELATED APPLICATIONS

The present application is a continuation-in-part of co-pending U.S. patent application Ser. No. 12/000,060, filed Dec. 7, 2007, the entire content of which is expressly incorporated herein by reference.

TECHNICAL FIELD

This patent application relates generally to plugs and sealing rings for sprinkler nozzles used in fire protection systems. More specifically, this patent application relates to combined plugs and sealing rings for use with sprinkler nozzles intended for highly corrosive and extremely corrosive environments, and related methods.

BACKGROUND

Many industrial facilities, such as large metallurgical smelters, steel industry pickling lines, semiconductor fabrication facilities, pulp and paper plants, inorganic chemical facilities, and power generation plants, generate extremely corrosive exhaust fumes, smoke, and particles during their operational processes. Various ductwork systems can be employed to remove or filter these hazardous wastes from the facilities. The ductwork systems are typically fabricated from combustible plastics such as polypropylene, chlorinated polyvinyl chloride, and fiberglass reinforced plastic. The ducts can be up to twelve feet in diameter, and can be hundreds of feet long, with various interconnecting vessels. Loss of a ductwork system due to fire can result in total shutdown of a key process or the entire plant for an extended period of time, and can lead to sizeable losses.

The environment inside the ductwork systems is typically extremely corrosive. High concentrations of inorganic acids, such as sulfuric, nitric, and hydrochloric acids, are often present in the ducts. In addition, the temperature inside the ducts may be very high, sometimes 100° C. or higher, and abrasive particles, such as metal, dust, and ash, may pass through the ducts at a high velocity, for example 40 miles/hour, or more. Thus, the environment inside the ducts can rapidly corrode or otherwise damage metallic structures, such as fire protection components (e.g., sprinkler nozzles).

Sprinkler nozzles have been developed that can withstand the highly corrosive environments mentioned above, for example, the sprinkler nozzles described in applicant's co-owned U.S. Patent Application Publication No. 2008/0308285 A1, the entire content of which is expressly incorporated herein by reference.

In order to prevent corrosive gasses from entering the sprinkler nozzle and/or associated piping, it is advantageous to fit a plug inside the nozzle orifice. However, high flow rates and/or turbulence inside the ductwork systems can cause the plugs to become dislodged from the nozzle orifice, and lost. In addition, conventional plugs and their retention means may tend to deteriorate under highly corrosive and extremely corrosive conditions. Furthermore, the sprinkler nozzle threads utilizing conventional sealing methods are vulnerable to corrosion and may tend to deteriorate under highly corrosive and extremely corrosive conditions. Accordingly, there remains a need in the art for nozzle plugs, sealing rings, and leashes that overcome these and other drawbacks of the prior art.

SUMMARY

A combined plug and sealing ring for a sprinkler nozzle comprises: a nozzle plug having a substantially cylindrical portion adapted to engage within a nozzle orifice of a sprinkler nozzle, and a cap overlaying the substantially cylindrical portion; a sealing ring adapted to seat onto a threaded pipe fitting portion of the sprinkler nozzle; and a leash interconnecting the nozzle plug and the sealing ring.

A combined plug and sealing ring in combination with a sprinkler nozzle comprises: a sprinkler nozzle including a threaded pipe fitting portion and a nozzle orifice; and a combined plug and sealing ring comprising: a nozzle plug having a substantially cylindrical portion adapted to engage within the nozzle orifice of the sprinkler nozzle, a cap overlaying the substantially cylindrical portion, a sealing ring adapted to seat onto the threaded pipe fitting portion of the sprinkler nozzle, and a leash interconnecting the nozzle plug and the sealing ring.

A method of installing a sprinkler nozzle in a highly corrosive or extremely corrosive environment comprises: seating a sealing ring onto a threaded pipe fitting portion of the sprinkler nozzle; inserting a substantially cylindrical portion of a nozzle plug into a nozzle orifice of the sprinkler nozzle until a cap of the nozzle plug seats against an upper edge of the nozzle orifice, the nozzle plug interconnected with the sealing ring; and threading the threaded pipe fitting portion of the sprinkler nozzle into a mounting block to thereby mount the sprinkler nozzle in the highly corrosive or extremely corrosive environment.

Further objectives and advantages, as well as the structure and function of preferred embodiments, will become apparent from a consideration of the description, drawings, and examples.

BRIEF DESCRIPTION OF THE DRAWINGS

The foregoing and other features and advantages of the invention will be apparent from the following, more particular description, as illustrated in the accompanying drawings wherein like reference numbers generally indicate identical, functionally-similar, and/or structurally similar elements.

DETAILED DESCRIPTION

Embodiments of the invention are discussed in detail below. In describing embodiments, specific terminology is employed for the sake of clarity. However, the invention is not intended to be limited to the specific terminology so selected. While specific embodiments are discussed, it should be understood that this is done for illustration purposes only. A person skilled in the relevant art will recognize that other components and configurations can be used without departing from the spirit and scope of the invention. All references cited herein are incorporated by reference as if each had been individually incorporated.

Figure 1:
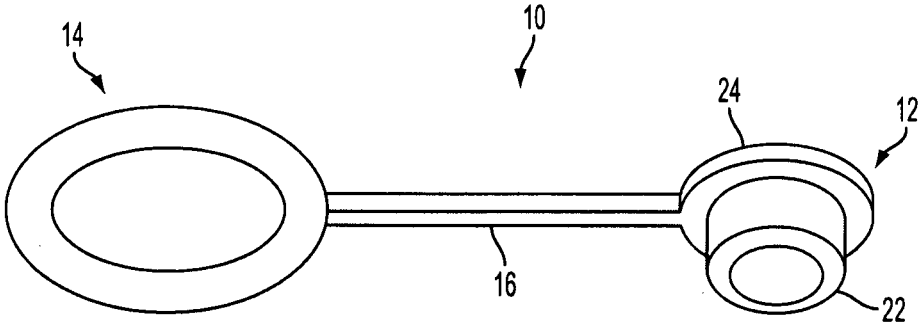
FIG. 1 is a perspective view of a first embodiment of a combined nozzle plug and sealing ring.

Referring to FIG. 1, an example embodiment of a combined plug and sealing ring 10 for use with a sprinkler nozzle is shown. The combined plug and sealing ring 10 can generally include a nozzle plug 12, a sealing ring 14, and a leash 16 that connects the nozzle plug 12 to the sealing ring 14. The combined plug and sealing ring 10 can be used to protect a sprinkler nozzle, for example, the sprinkler nozzle 20 shown in FIGS. 2 and 3.

Figure 2:
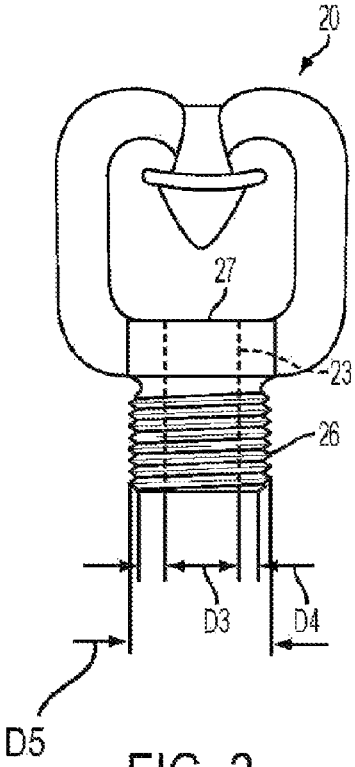
FIG. 2 is a front view of an embodiment of a sprinkler nozzle.
Figure 3:
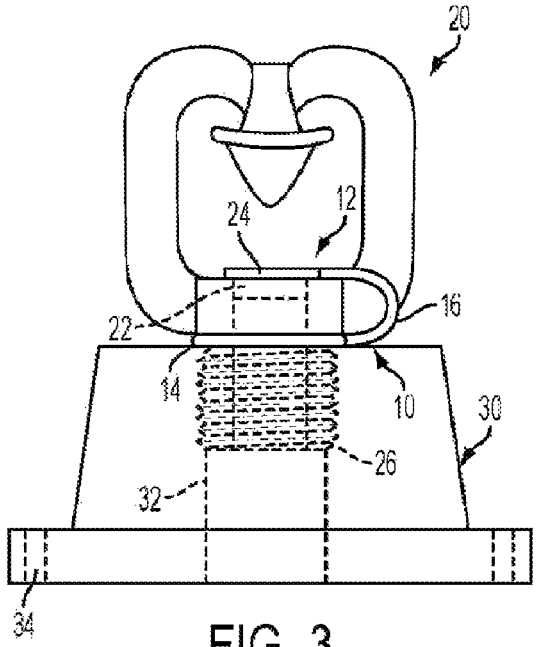
FIG. 3 is a front view of the sprinkler nozzle of FIG. 2 attached to an example mounting block and having an example combined nozzle plug and sealing ring attached thereto.

Referring to FIGS. 1-3, the nozzle plug 12 can include a substantially cylindrical portion 22 that is adapted to engage within and seal the nozzle orifice 23 of the sprinkler nozzle 20, for example, against hot corrosive gases or other substances entering the nozzle orifice 23, which could damage and corrode the interior of the nozzle orifice 23 and/or pipes in communication therewith. The nozzle plug 12 can also include a cap portion 24 that has an outer peripheral dimension, e.g., diameter, that is larger than the diameter of the substantially cylindrical portion 22. Accordingly, as shown in FIG. 3, the substantially cylindrical portion 22 can be pressed into the nozzle orifice 23 until the cap portion 24 contacts the upper edge 27 of the nozzle orifice 23, at which point the nozzle plug 12 is fully seated within the orifice 23.

Figure 4:
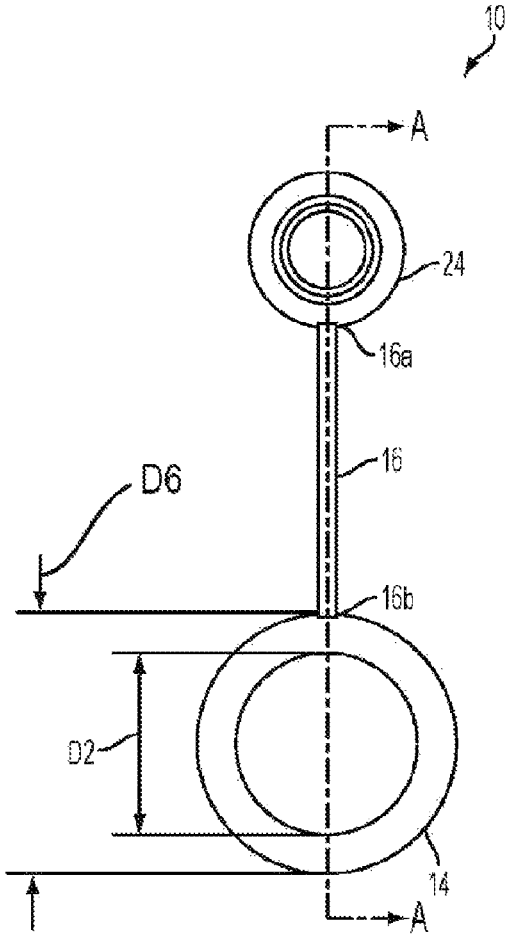
FIG. 4 is a top view of the combined nozzle plug and sealing ring of FIG. 1.

Referring to FIG. 3, the sealing ring 14 can be adapted to seat around the threaded pipe fitting 26 when the sprinkler nozzle 20 is connected to another component, for example, a mounting block 30. The sealing ring 14 may seal the threads of the pipe fitting 26 against migration of corrosive vapors. The threads of the pipe fitting 26 may be uncoated and susceptible to deterioration by corrosive vapors over time. Hence, the sealing ring 14 can help seal the interface between the sprinkler nozzle 20 and the mounting block 30, as shown in FIG. 3, and help prevent migration of the corrosive vapors into the threads, thereby prolonging the life of the threads. As shown in FIG. 2, the threaded pipe fitting 26 can define an outermost thread diameter D5. As shown in FIG. 4, the sealing ring 14 can define a sealing ring outer diameter D6. Referring to FIG. 3, the sealing ring outer diameter D6 can be greater than the outermost thread diameter D5. As shown in FIG. 3, an example mounting block 30 can include a conduit 32 that provides fluids to the sprinkler nozzle 20, and one or more mounting hole 34 for securing the mounting block 30 in the service environment, however, other configurations are possible.

As stated previously, the leash 16 connects the nozzle plug 12 and the sealing ring 14 together. The leash 16 can serve to prevent loss of the nozzle plug 12 in the event it becomes dislodged from the nozzle orifice 23, for example, due to turbulent air flow around the sprinkler nozzle 20. In addition, the leash 16 can facilitate easy and accurate field installation of the sealing ring 14 and nozzle plug 12. According to an embodiment, the nozzle plug 12, sealing ring 14, and leash 16 can be integral with one another. For example, they may be co-molded with one another. In order to facilitate sighting of a dislodged nozzle plug 12 upon inspection, the nozzle plug 12 can be specifically colored and/or constructed, e.g., enlarged. Additionally or alternatively, the position and/or construction of the leash can be configured to facilitate easy sighting of the nozzle plug 12, when dislodged.

Figure 5:
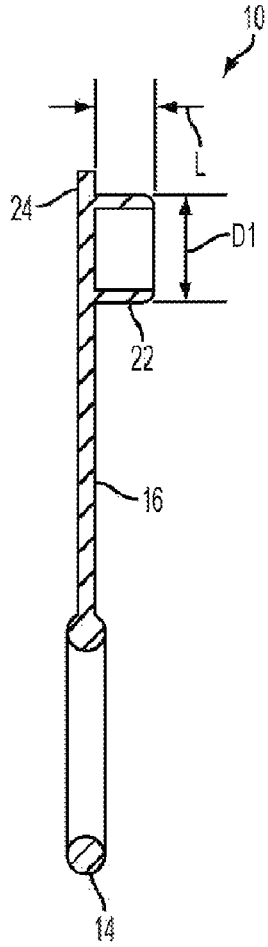
FIG. 5 is a cross-sectional view of the combined nozzle plug and sealing ring of FIG. 1, as seen in direction A-A of FIG. 4.

Referring to FIGS. 4 and 5, a top view and a cross-sectional view of the combined plug and sealing ring 10 are shown. As shown, the substantially cylindrical portion 22 of the nozzle plug 12 can define an outer diameter D1. In the embodiment shown, the substantially cylindrical portion 22 is substantially tubular and defines a hollow region defined by the walls of the substantially cylindrical portion and the underside of the cap portion 24, however, other configurations are possible.

The leash 16 can include a first end 16*a* that is connected to the cap portion 24 of the nozzle plug 12, for example, is co-molded therewith. The leash 16 can include a second end 16*b* that is connected to the sealing ring 14, for example, is co-molded with. The second end 16*b* of the leash 16 can extend from the sealing ring 14 in a substantially radial direction, as shown in FIG. 4, however, other orientations are also possible.

Referring to FIGS. 4 and 5 in conjunction with FIG. 2, the outer diameter D1 of the substantially cylindrical portion 22 can be substantially equal to or greater than the inner diameter D3 of the nozzle orifice 23. As a result, the substantially cylindrical portion 22 can fit snugly within the nozzle orifice 23, e.g., by forming an interference fit, however, other configurations are possible. According to the embodiment of FIGS. 4 and 5, the outer diameter D1 can be between about 0.3 and 0.6 inches, between about 0.4 and 0.5 inches, or approximately 0.43 inches, however, other sizes are possible. According to an embodiment, the substantially cylindrical portion 22 can define a length L of between about 0.2 and 0.4 inches, between about 0.2 and 0.3 inches, or approximately 0.23 inches, however, other sizes are possible.

Still referring to FIGS. 4 and 5 in conjunction with FIG. 2, the inner diameter D2 of the sealing ring 14 can be substantially equal to or less than the outer diameter D4 of the threaded pipe fitting 26, thus allowing the sealing ring 14 to fit snugly around the threaded pipe fitting 26 and form a tight seal. According to an embodiment, the inner diameter D2 can be between about 0.6 and 0.9 inches, between about 0.7 and 0.8 inches, or approximately 0.734 inches, however, other sizes are possible. According to an embodiment, the leash 16 can define a distance between the first end 16*a* and the second end 16*b* of between about 1 and 2 inches, between about 1 and 1.5 inches, or approximately 1.25 inches, however, other sizes are possible.

Figure 6:
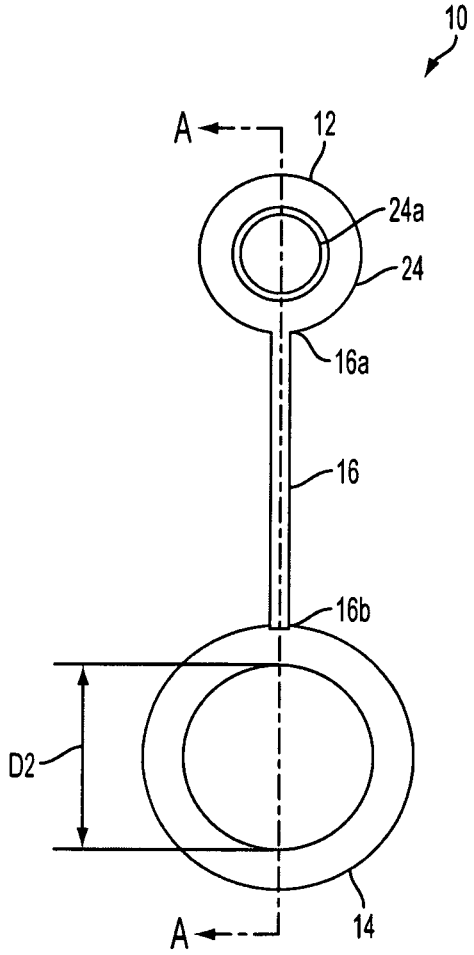
FIG. 6 is a top view of a second embodiment of a combined nozzle plug and sealing ring.
Figure 7:
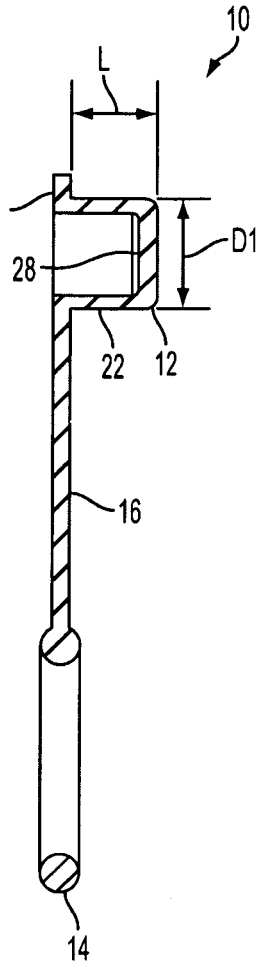
FIG. 7 is a cross-sectional view of the combined nozzle plug and sealing ring of FIG. 6, as seen in direction A-A of FIG. 6.

FIGS. 6 and 7 depict another example embodiment of a combined plug and sealing ring 10. The combined plug and sealing ring 10 of FIGS. 6 and 7 is substantially similar to the embodiment of FIGS. 1-3, except for the configuration of the nozzle plug 12. As seen in FIG. 7, the nozzle plug 12 can comprise a substantially cylindrical portion 22 that is substantially tubular and defines a hollow interior. However, the cap portion 24 can include an aperture 24*a* that is in communication with the hollow interior. In addition, an auxiliary cap 28 can be located at the end of the substantially cylindrical portion 22 opposed from the cap portion 24. In the embodiment of FIGS. 6 and 7, the outer diameter D1 of the substantially cylindrical portion 22 can be between about 0.3 and 0.6 inches, between about 0.4 and 0.5 inches, or approximately 0.43 inches, however, other sizes are possible. According to an embodiment, the substantially cylindrical portion 22 can define a length L of between about 0.2 and 0.5 inches, between about 0.3 and 0.4 inches, or approximately 0.38 inches, however, other sizes are possible.

Still referring to FIGS. 6 and 7, the inner diameter D2 of sealing ring 14 can be between about 0.6 and 0.9 inches, between about 0.7 and 0.8 inches, or approximately 0.734 inches, however, other sizes are possible. According to an embodiment, the leash 16 can define a distance between the first end 16*a* and the second end 16*b* of between about 1 and 2 inches, between about 1 and 1.5 inches, or approximately 1.25 inches, however, other sizes are possible.

According to embodiments, the nozzle plug 12, sealing ring 14, and leash 16 can be co-molded from a polymer that exhibits resistance to corrosion. For example, the polymer may exhibit high resistance to highly corrosive environments such as $HF/HNO_3$, $H_2SO_4$, and/or HCl acids. According to an embodiment, the nozzle plug 12, sealing ring 14, and leash 16 can be co-molded from a fluoroelastomer (fluorocarbon-based synthetic rubber), such as FKM-fluoroelastomers, FFKM-perfluoro-elastomers, and FEPM-tetrafluoro-ethylene/propylene rubbers. According to an embodiment, the nozzle plug 12, sealing ring 14, and leash 16 are co-molded from FKM P959 perfluoroelastomer without ZnO, which is available from Solvay SA, rue du Prince Albert 33, B-1050, Brussels, Belgium.

Referring to FIGS. 2 and 3, the combined plug and sealing ring 10 described herein can be used in conjunction with a corrosion-resistant sprinkler nozzle 20 to provide fire protection in highly-corrosive and extremely-corrosive service environments, such as exhaust ductwork systems for pickling plants and sulfuric acid plants. These ductwork systems can convey $HF/HNO_3$, $H_2SO_4$, and/or HCl acids at high speeds (e.g., 40 mph or more) and high temperatures (e.g., up to 100° C.), leading to rapid deterioration of fire protection equipment located in the ducts. The combined plug and sealing ring 10 can be used in combination with corrosion-resistant sprinkler nozzles to protect these types of highly-corrosive and extremely-corrosive environments.

According to an embodiment, the sprinkler nozzle 20 can comprise a corrosion-resistant sprinkler nozzle of the type disclosed in applicant's co-owned U.S. Patent Application Publication No. 2008/0308285 A1, the entire content of which is expressly incorporated herein by reference. According to an embodiment, all or a portion of the sprinkler nozzle 20 can comprise a base substrate made from C22, C276, C2000, G30, or 1686 alloy, and a corrosion resistant coating of ECTFE or ETFE formed over the base substrate, however, other configurations are possible.

With respect to FIGS. 2 and 3, an example embodiment of a method of installing the sprinkler nozzle 20 in a highly-corrosive or extremely corrosive environment can comprise seating the sealing ring 14 onto the threaded pipe fitting portion 26 of the sprinkler nozzle 20, and inserting the nozzle plug 12 into the nozzle orifice 23 until the nozzle plug 14 is fully seated therein. The threaded pipe fitting portion 26 of the sprinkler nozzle 20 can be threaded into a network of pipes or other conduits, for example, by threading it into a mounting block located in a duct. The aforementioned steps can occur in any order, and are not limited to the specific sequence listed above. As stated previously, the nozzle plug 12 will prevent corrosive substances from entering the sprinkler orifice 23 and deteriorating the interior of the sprinkler nozzle 20 and the associated pipework. Additionally or alternatively, the sealing ring 14 will prevent corrosive substances from deteriorating the exposed threads of the threaded pipe fitting 26, thereby extending the life of the sprinkler nozzle 20. In the event the nozzle plug 12 becomes dislodged from the nozzle orifice 23, the leash 16 will prevent the nozzle plug 12 from becoming lost. Accordingly, a mechanic can substantially re-install the nozzle plug 12 into the nozzle orifice 23.

The embodiments illustrated and discussed in this specification are intended only to teach those skilled in the art the best way known to the inventors to make and use the invention. Nothing in this specification should be considered as limiting the scope of the present invention. All examples presented are representative and non-limiting. The above-described embodiments of the invention may be modified or varied, without departing from the invention, as appreciated by those skilled in the art in light of the above teachings. It is therefore to be understood that, within the scope of the claims and their equivalents, the invention may be practiced otherwise than as specifically described.

The invention claimed is:

1. A combined plug and sealing ring for a sprinkler nozzle, comprising:

a nozzle plug having a substantially cylindrical portion adapted to engage within a nozzle orifice of a sprinkler nozzle, and a cap overlaying the substantially cylindrical portion;

a thread sealing ring adapted to seat onto and seal a threaded pipe fitting portion of the sprinkler nozzle, the threaded pipe fitting portion defining an outermost thread diameter, wherein the thread sealing ring defines a sealing ring outer diameter that is larger than the outermost thread diameter; and a leash interconnecting the nozzle plug and the thread sealing ring, wherein the nozzle plug, thread sealing ring, and leash are monolithic and are co-molded from a corrosion-resistant polymer.

2. The combined plug and sealing ring of claim 1, wherein the corrosion-resistant polymer comprises a fluoroelastomer.

3. The combined plug and sealing ring of claim 2, wherein the corrosion-resistant polymer comprises a fluoroelastomer selected from the group consisting of FKM-fluoroelastomers, FFKM-perfluoro-elastomers, or FEPM-tetrafluoro-ethylene/propylene rubbers.

4. The combined plug and sealing ring of claim 1, wherein the leash includes a first end connected to the cap and a second end connected to the thread sealing ring and extending substantially radially from the thread sealing ring.

5. The combined plug and sealing ring of claim 1, wherein the substantially cylindrical portion of the nozzle plug defines an outer diameter that is equal to or greater than an inner diameter of the nozzle orifice of the sprinkler nozzle.

6. A combined plug and sealing ring in combination with a sprinkler nozzle, comprising:

a sprinkler nozzle including a threaded pipe fitting portion and a nozzle orifice; and a combined plug and sealing ring comprising:

a nozzle plug having a substantially cylindrical portion adapted to engage within the nozzle orifice of the sprinkler nozzle, a cap overlaying the substantially cylindrical portion, and a thread sealing ring adapted to seat onto and seal the threaded pipe fitting portion of the sprinkler nozzle, the threaded pipe fitting portion defining an outermost thread diameter, wherein the thread sealing ring defines a sealing ring outer diameter that is larger than the outermost thread diameter, and a leash interconnecting the nozzle plug and the thread sealing ring, wherein the nozzle plug, thread sealing ring, and leash are monolithic and are co-molded from a corrosion-resistant polymer.

7. The combination of claim 6, wherein the corrosion resistant-polymer comprises a fluoroelastomer.

8. The combination of claim 7, wherein the corrosion-resistant polymer comprises a fluoroelastomer selected from the group consisting of FKM-fluoroelastomers, FFKM-perfluoro-elastomers, or FEPM-tetrafluoro-ethylene/propylene rubbers.

9. The combination of claim 6, wherein the leash includes a first end connected to the cap and a second end connected to the thread sealing ring and extending substantially radially from the thread sealing ring.

10. The combination of claim 6, wherein the nozzle orifice of the sprinkler nozzle defines an inner diameter, and the substantially cylindrical portion of the nozzle plug defines an outer diameter that is equal to or greater than the inner diameter of the nozzle orifice.

11. The combination of claim 6, wherein at least a portion of the sprinkler nozzle comprises a base substrate selected from the group consisting of C22, C276, C2000, G30, or I686, and a corrosion resistant coating formed over the base substrate, the corrosion resistant coating selected from the group consisting of ECTFE or ETFE, further wherein the corrosion-resistant polymer of the combined plug and sealing ring comprises a fluoroelastomer selected from the group consisting of FKM-fluoroelastomers, FFKM-perfluoro-elastomers, or FEPM-tetrafluoro-ethylene/propylene rubbers.

12. A method of installing a sprinkler nozzle in a highly corrosive or extremely corrosive environment, comprising:

seating a thread sealing ring onto a threaded pipe fitting portion of the sprinkler nozzle, the threaded pipe fitting portion defining an outermost thread diameter wherein the thread sealing ring defines a sealing ring outer diameter that is larger than the outermost thread diameter;

inserting a substantially cylindrical portion of a nozzle plug into a nozzle orifice of the sprinkler nozzle until a cap of the nozzle plug seats against an upper edge of the nozzle orifice, the nozzle plug interconnected with the thread sealing ring; and threading the threaded pipe fitting portion of the sprinkler nozzle into a mounting block to thereby mount the sprinkler nozzle in the highly corrosive or extremely corrosive environment, wherein the thread sealing ring forms a seal between the threaded pipe fitting portion and the mounting block;

wherein the nozzle plug, thread sealing ring, and leash are monolithic and are co-molded from a corrosion-resistant polymer.

13. A method of installing a sprinkler nozzle in a highly corrosive or extremely corrosive environment, comprising:

seating a thread sealing ring onto a threaded pipe fitting portion of the sprinkler nozzle, the threaded pipe fitting portion defining an outermost thread diameter, wherein the thread sealing ring defines a sealing ring outer diameter that is larger than the outermost thread diameter;

inserting a substantially cylindrical portion of a nozzle plug into a nozzle orifice of the sprinkler nozzle until a cap of the nozzle plug seats against an upper edge of the nozzle orifice, the nozzle plug interconnected with the thread sealing ring; and threading the threaded pipe fitting portion of the sprinkler nozzle into a mounting block to thereby mount the sprinkler nozzle in the highly corrosive or extremely corrosive environment, wherein the thread sealing ring forms a seal between the threaded pipe fitting portion and the mounting block;

wherein the nozzle plug, thread sealing ring, and leash are monolithic and are co-molded from a corrosion-resistant polymer, wherein the environment comprises a duct that transports $HF/HNO_3$, $H_2SO_4$, and/or HCl acids.

14. The method of claim 12, further comprising:

re-inserting the substantially cylindrical portion of the nozzle plug into the nozzle orifice after the substantially cylindrical portion dislodges from the nozzle orifice.

15. The method of claim 12, wherein the corrosion-resistant polymer comprises a fluoroelastomer.

16. The method of claim 15, wherein the corrosion-resistant polymer comprises a fluoroelastomer selected from the group consisting of FKM-fluoroelastomers, FFKM-perfluoro-elastomers, or FEPM-tetrafluoro-ethylene/propylene rubbers.

17. The method of claim 12, wherein at least a portion of the sprinkler nozzle comprises a base substrate selected from the group consisting of C22,C276, C2000, G30, or I686, and a corrosion resistant coating formed over the base substrate, the corrosion resistant coating selected from the group consisting of ECTFE or ETFE, further wherein the corrosion-resistant polymer of the combined plug and sealing ring comprises a fluoroelastomer selected from the group consisting of FKM-fluoroelastomers, FFKM-perfluoro-elastomers, or FEPM-tetrafluoro-ethylene/propylene rubbers.

18. The combined plug and sealing ring of claim 1, wherein the thread sealing ring is adapted to seal continuously around the perimeter of the threaded pipe fitting portion of the sprinkler nozzle.

19. The combination of claim 6, wherein the thread sealing ring is adapted to seal continuously around the perimeter of the threaded pipe fitting portion of the sprinkler nozzle.

20. The method of claim 12, further comprising:

sealing continuously around the perimeter of the threaded pipe fitting portion of the sprinkler nozzle with the thread sealing ring.

* * * * *